US010810928B2

(12) United States Patent
Lim et al.

(10) Patent No.: US 10,810,928 B2
(45) Date of Patent: Oct. 20, 2020

(54) DATA LINE DRIVING CIRCUIT, DISPLAY DRIVING CIRCUIT, AND METHOD DRIVING DISPLAY

(71) Applicant: SAMSUNG ELECTRONICS CO., LTD., Suwon-si, Gyeonggi-do (KR)

(72) Inventors: Hyun-Wook Lim, Seoul (KR); Dong-Myung Lee, Hwaseong-si (KR); Jae-Suk Yu, Seoul (KR); Kil-Hoon Lee, Seoul (KR); Jae-Youl Lee, Hwaseong-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 16/168,036

(22) Filed: Oct. 23, 2018

(65) Prior Publication Data

US 2019/0197941 A1 Jun. 27, 2019

(30) Foreign Application Priority Data

Dec. 26, 2017 (KR) ..... 10-2017-0179803

(51) Int. Cl.

| | |
|---|---|
| ***G09G 3/20*** | (2006.01) |
| *G09G 3/36* | (2006.01) |
| *G09G 5/00* | (2006.01) |
| *G09G 3/3275* | (2016.01) |

(52) U.S. Cl.

CPC ..... *G09G 3/2096* (2013.01); *G09G 3/20* (2013.01); *G09G 3/3275* (2013.01); *G09G 3/3688* (2013.01); *G09G 5/008* (2013.01); *G09G 2310/0275* (2013.01); *G09G 2310/06* (2013.01); *G09G 2310/08* (2013.01); *G09G 2330/12* (2013.01); *G09G 2370/08* (2013.01)

(58) Field of Classification Search

CPC . G09G 2370/08; G09G 3/006; G09G 2330/12
See application file for complete search history.

(56) References Cited

U.S. PATENT DOCUMENTS

| | | | |
|---|---|---|---|
| 7,372,448 | B2 | 5/2008 | Kim |
| 7,555,089 | B2 | 6/2009 | Faulkner |
| 9,236,017 | B2 | 1/2016 | Park |
| 9,710,114 | B2 | 7/2017 | Lee |
| 9,711,103 | B2 | 7/2017 | Lee et al. |
| 2005/0052437 | A1 | 3/2005 | Hudson |
| 2007/0132674 | A1 | 6/2007 | Tsuge |

(Continued)

FOREIGN PATENT DOCUMENTS

| | | |
|---|---|---|
| KR | 1020010029587 | 4/2001 |
| KR | 100708307 | 4/2007 |
| KR | 100937509 | 1/2010 |

*Primary Examiner* — Yuzhen Shen

(74) *Attorney, Agent, or Firm* — Volentine, Whitt & Francos, PLLC

(57) ABSTRACT

A method of driving a display by communicating with a controller through a first channel and a second channel includes; generating recovery data from a signal received through the first channel during a frame data period, detecting a vertical blank period between frame data periods, checking a training trigger event history during the vertical blank period, and during the vertical blank period, transmitting a training request direct to the first channel through the second channel when there is a training trigger event history.

20 Claims, 14 Drawing Sheets

(56) References Cited

U.S. PATENT DOCUMENTS

| | | | | |
|---|---|---|---|---|
| 2012/0056870 | A1 | 3/2012 | Koh | |
| 2013/0036335 | A1* | 2/2013 | Kim | G09G 3/006 714/704 |
| 2013/0113777 | A1* | 5/2013 | Baek | G09G 3/20 345/212 |
| 2015/0187315 | A1* | 7/2015 | Park | G09G 3/3685 345/99 |
| 2015/0325200 | A1* | 11/2015 | Rho | G09G 3/20 345/212 |

* cited by examiner

DATA LINE DRIVING CIRCUIT, DISPLAY DRIVING CIRCUIT, AND METHOD DRIVING DISPLAY

CROSS-REFERENCE TO RELATED APPLICATION

This application claims the benefit of Korean Patent Application No. 10-2017-0179803 filed on Dec. 26, 2017, the subject matter of which is hereby incorporated by reference.

BACKGROUND

The inventive concept relates to circuits and methods associated with driving a display. More particularly, the inventive concept relates to data line driving circuits, display driving circuits including data line driving circuits, and methods of driving displays.

A display device may include a display panel outputting visually discernable images in response to various electrical signals, including signals provided by a display driving circuit. The display driving circuit may receive image data from an external host and provide (or transmit) signals corresponding to the received image data to a plurality of data lines arranged in the display panel. This general approach may be understood as driving the display panel. With increases in the resolution of display panels as well as rates of updating images (e.g., increases in the frame rate of the display panel), constituent display driving circuit(s) are required to operate at higher signal processing rates.

Due to increasing working rate demands and challenging driving environments for contemporary display driving circuit(s), errors may occur while the display driving circuit is driving a display panel, thereby producing erroneous images.

SUMMARY

The inventive concept relates to methods and circuits that may be used to drive a display. A data line driving circuit or a display driving circuit, or a method of driving a display is provided to reduce or preclude the possibility of an erroneous image being displayed by the display panel.

In one aspect the inventive concept provides a data line driving circuit configured to communicate with a controller through a first channel and a second channel. The data line driving circuit includes; a control circuit comprising a register configured to store training trigger event information associated with a training trigger event, detect a vertical blank period between frame data periods, and transmit a training request directed to the first channel through the second channel during the vertical blank period in response to the training trigger event information, and a synchronization circuit configured to generate a recovery clock signal synchronized with a training pattern received through the first channel during the vertical blank period, and generate recovery data from a signal received through the first channel in response to the recovery clock signal during a frame data period.

In another aspect, the inventive concept provides a display driving circuit including; a controller configured to transmit frame data through a first channel during a frame data period and transmit a training pattern through the first channel in response to a training request received through a second channel, and a data line driving circuit configured to detect a vertical blank period between frame data periods in response to a signal received from the controller and transmit the training request through the second channel during the vertical blank period.

In still another aspect, the inventive concept provides a method of driving a display by communicating with a controller through a first channel and a second channel, wherein the method includes; generating recovery data from a signal received through the first channel during a frame data period, detecting a vertical blank period between frame data periods, checking a training trigger event history during the vertical blank period, and during the vertical blank period, transmitting a training request direct to the first channel through the second channel when there is a training trigger event history.

BRIEF DESCRIPTION OF THE DRAWINGS

Embodiments of the inventive concept will be more clearly understood from the following detailed description taken in conjunction with the accompanying drawings in which.

DETAILED DESCRIPTION

Figure 1:
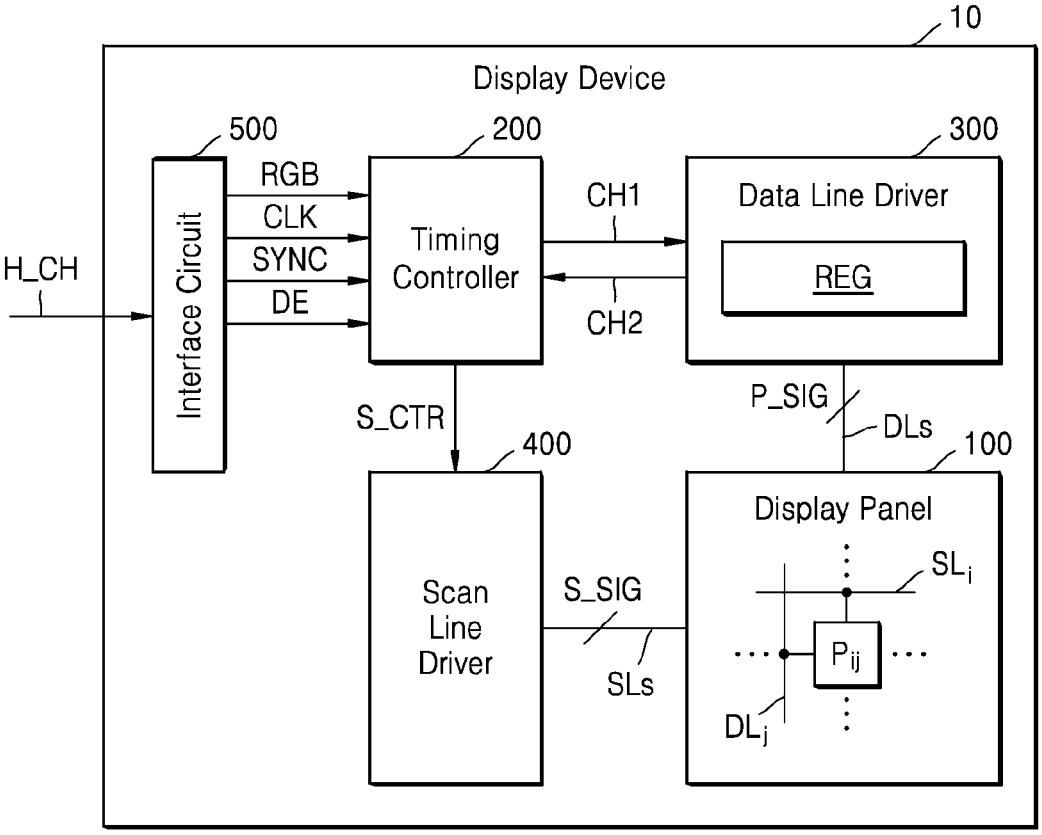
FIG. 1 is a block diagram of a display device.

FIG. 1 is a block diagram of a display device 10 according to an embodiment. The display device 10 may be included in various electronic devices. In some possible implementation examples, the display device 10 may be included in a mobile phone, a tablet personal computer (PC), a portable multimedia player (PMP), a digital camera, a wearable device, a television (TV), a digital video disk (DVD) player, a refrigerator, an air conditioner, an air purifier, a set-top box, medical equipment, a navigation device, electronic devices for vehicles, furniture, or various measuring instruments.

Referring to FIG. 1, the display device 10 includes a display panel 100, a timing controller 200, a data line driver 300, a scan line driver 400, and an interface circuit 500. The timing controller 200, the data line driver 300, and the scan line driver 400 may be collectively referred to as a display driver or a display driving circuit.

The display panel 100 may include pixels arranged in a matrix form, and as each pixel outputs a visual signal, the display panel 100 may display images in units of frames. The display panel 100 may be implemented, for example, as a Liquid Crystal Display (LCD), a Light Emitting Diode (LED) display, an Organic LED (OLED) display, an Active-Matrix OLED (AMOLED) display, an Electrochromic Device (ECD), a Digital Mirror Device (DMD), an Actuated Mirror Device (AMD), a Grating Light Valve (GLV), a Plasma Display Panel (PDP), an Electro Luminescent Display (ELD), a Vacuum Fluorescent Display (VFD), or the like, and may have a shape such as a flat panel display, a curved display, or a flexible display.

The display panel 100 may include scan lines SLs arranged in a row direction, data lines DLs arranged in a column direction, and pixels formed at intersections of the scan lines SLs and the data lines DLs. For example, as illustrated in FIG. 1, the display panel 100 may include a pixel $P_{ij}$ connected to a scan line $SL_i$ and a data line $DL_j$ at an intersection of the scan line $SL_i$ and the data line $DL_j$. Adjacent pixels, which respectively output signals having different colors (e.g., red, green, blue, etc.) and are connected to the same scan line, may be collectively referred to as a unit pixel, and pixels included in one unit pixel may be referred to as sub-pixels, respectively.

In the display panel 100, pixels in one row may be commonly connected to one of the scan lines SLs. The scan lines SLs may be sequentially (e.g., one-by-one) activated, and accordingly, pixels included in the same row (i.e., pixels commonly connected to the same scan line) may be simultaneously driven. A period during which pixels included in a row are driven may be referred to as a horizontal driving period.

The timing controller 200 may receive color data (e.g., RGB data) and timing signals (e.g., clock signals CLK, synchronization signals SYNC, and data enable signals DE) which are extracted from signals received by the interface circuit 500 from an external device (e.g., a host device) of the display device 10 through a host channel H_CH. The timing controller 200 may control the data line driver 300 and the scan line driver 400 in response to the color data and the timing signals. The timing controller 200 may also synchronize operations of the scan line driver 400 and the data line driver 300 in a manner whereby signals are transmitted to the pixels of the display panel 100 through the data lines DLs and the scan lines SLs at the time. For example, the timing controller 200 may provide the scan line driver 400 with scan control signals S_CTR so as to output, through the scan lines SLs, scan signals S_SIG for selecting pixels corresponding to pixel signals P_SIG provided through the data lines DLs. In certain embodiments, the timing controller 200 may be referred to simply as a controller.

The timing controller 200 may communicate with the data line driver 300 through a first channel CH1 and a second channel CH2. In some embodiments, the timing controller 200 may convert the color data (e.g., RGB data) received from the interface circuit 500 and may transmit the resulting converted data to the data line driver 300 through the first channel CH1. As will be described below with reference to FIG. 2, the data transmitted through the first channel CH1 may include a so-called training pattern as well as frame data, and vertical blank data, where the frame data may include a series of line data. In some embodiments, the timing controller 200 may receive a signal including state information associated with the data line driver 300 from the data line driver 300 through the second channel CH2. For example, as will be described below with reference to FIG. 2, the timing controller 200 may receive a training request from the data line driver 300 through the second channel CH2 and may provide the data line driver 300 with a training pattern for training the first channel CH1 in response to the training request. In the certain embodiments, the first channel CH1 may be referred to as a forward channel or a primary channel, and the second channel CH2 may be referred to as a backward channel or a secondary channel.

As noted above, due to higher resolution requirements for the display panel 100 (e.g., an increased number of pixels and/or a higher frame rate), the timing controller 200, the data line driver 300, and the scan line driver 400 may be required to operate a markedly higher working rate. Further, the amount of data transmitted from the timing controller 200 to the data line driver 300 through the first channel CH1 may increase. For example, the first channel CH1 may employ a serial communication channel.

The data line driver 300 may output a pixel signal P_SIG through the data lines DLs in response to the signal received through the first channel CH1. For example, the data line driver 300 may generate an analog signal (e.g., a gray voltage or a gray current) in response to the data received through the first channel CH1, and may generate the pixel signal P_SIG by amplifying the analog signal. During a horizontal driving period, the data line driver 300 may output the pixel signal P_SIG for the pixels included in a row of the display panel 100, and the data lines DLs may be charged or discharged in response to the pixel signal P_SIG. The data line driver 300 may be referred to as a data line driving circuit, a column driver, a column driving circuit, a data driver, a data driving circuit, a source driver, a source driving circuit, or the like.

As illustrated in FIG. 1, the data line driver 300 may include a register REG configured to store information associated with the occurrence of certain training trigger events. For example, driving errors associated with data line driver 300 may occur for various reasons such as a high data transmission rate through the first channel CH1 and/or the working environment of the data line driver 300. As the result of driving errors occurring in the data line driver 300, the data line driver 300 may not validly obtain data from the first channel CH1, and accordingly, the display panel 100 may output an erroneous image.

Upon the occurrence of a driving error in the data line driver 300, the training of the first channel CH1 may be performed in such a manner that the data line driver 300 normally obtains the data received from timing controller 200 through the first channel CH1. For example, the data line driver 300 may provide a training request directed to the first channel CH1 to the timing controller 200 through the second channel CH2. In response, the timing controller 200 may provide a training pattern to the data line driver 300 through the first channel CH1. The data line driver 300 may generate a signal (e.g., a recovery clock signal RCK of FIG. 3) synchronized with the training pattern in response to the received training pattern. Then, the data line driver 300 may validly obtain data received through the first channel CH1 in response to the synchronized signal. As described above in certain embodiments, an error associated with the data line driver 300 causing the training of the first channel CH1 may be referred to as a training trigger event.

As will be described hereafter in some additional detail, when the training trigger event occurs, the data line driver 300 according to certain embodiments may store information about the training trigger event in the register REG. The data line driver 300 may detect a period during which the pixel signal P_SIG is not provided to the display panel 100 through the data lines DLs, and during these period(s), the training of the first channel CH1 may be requested from the timing controller 200 in response to the information stored in the register REG. Accordingly, the frequency with which erroneous images are output by the display panel 100 may be decreased. As better continuity of images output by the display panel 100 is realized, adverse visual effects due to the errors may be decreased. Some examples of the data line driver 300 will be described below with reference to FIGS. 3, 4, 5, 6, and 7, inclusively FIGS. 3-7.

The scan line driver 400 may provide the display panel 100 with the scan signals S_SIG through the scan lines SLs, according to the scan control signal S_CTR received from the timing controller 200. For example, the scan line driver 400 may sequentially activate the scan lines SLs in response to the scan control signals S_CTR, and accordingly, pixels connected to the activated scan lines SLs may output visual signals according to the pixel signals P_SIG provided through the data lines DLs. The scan line driver 400 may be referred to as a scan line driving circuit, a row driver, a row driving circuit, a scan driver, a scan driving circuit, a gate driver, a gate driving circuit, or the like.

In some embodiments, components of the display driver, that is, the timing controller 200, the data line driver 300, and the scan line driver 400, may be respectively implemented in separate semiconductor packages, and in some embodiments, two or more of the components of the display driver may be included in a single semiconductor package. In addition, at least one (e.g., the scan line driver 400) of the components of the display driver may be integrated on the display panel 100.

The interface circuit 500 may receive/transmit signals from/to an external device, e.g., a host (or a host device), through a host channel H_CH. In some embodiments, as a non-limited example, the interface circuit 500 may support a Red Green Blue (RGB) interface, a Central Processing Unit (CPU) interface, a serial interface, a Mobile Display Digital Interface (MDDI), an Inter Integrated Circuit (I2C) interface, a Serial Peripheral Interface (SPI), a Micro Controller Unit (MCU) interface, a Mobile Industry Processor Interface (MIPI), an embedded Display Port (eDP) interface, a D-subminiature (D-sub) interface, an optical interface, a High Definition Multimedia Interface (HDMI), or the like. Also, in some embodiments, as a non-limited example, the interface circuit 500 may support a Mobile High-definition Link (MHL) interface, a Secure Digital (SD) card/Multi-Media Card (MMC) interface, or an infrared Data Association (IrDA) standard interface.

Figure 2:
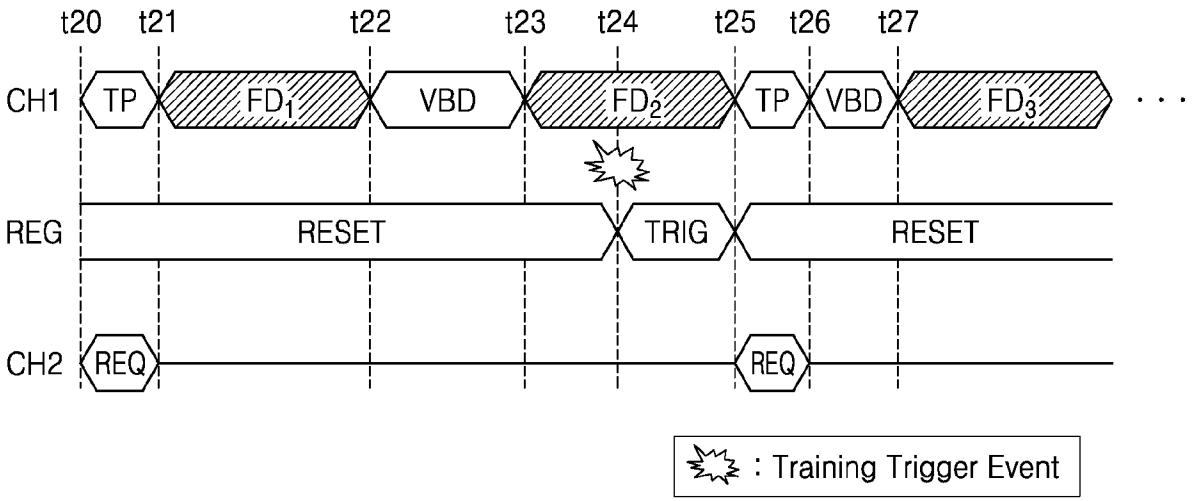
FIG. 2 is a timing diagram further describing in one example operation of the data line driver of FIG. 1.

FIG. 2 is a timing diagram further illustrating operation of the data line driver 300 of FIG. 1. Here, the first channel CH1 and the second channel CH2 between the timing controller 200 and the data line driver 300 as well as one or more data value(s) associated with training trigger event information stored in the register REG included in the data line driver 300 are shown. As described above with reference to FIG. 1, the register REG of the data line driver 300 may store the information associated with one or more training trigger event(s).

Referring now to FIGS. 1 and 2, after power is supplied to the display device 10, the data line driver 300 may transmit a training request REQ to the timing controller 200 through the second channel CH2 requesting the training of the first channel CH1 at an arbitrarily assumed time t20. In response, the timing controller 200 may transmit a training pattern TP through the first channel CH1. The data line driver 300 may generate a signal synchronized with the training pattern TP in response to the received training pattern TP. A period during which the first channel CH1 is trained (e.g., the period extending from time t20 to time t21) allows the timing controller 200 to provide the training pattern TP and the data line driver 300 to generate the signal synchronized with the training pattern TP. This period may be referred to hereafter as a training period, where a first occurring training period for the first channel CH1 following an initial power-up for the display device 10 may be referred to as an initial training period. At the time t20 or before, the register REG may be placed in a reset state, thereby storing one or more reset value(s).

At the time t21, after the generation of the signal synchronized, the data line driver 300 may release the training request REQ through the second channel CH2. The timing controller 200 may transmit a first frame data $FD_1$ through the first channel CH1 in response to the release of the training request REQ. Frame data FD is data corresponding to a frame of image data (hereafter, image) as output (e.g.) from the display panel 100, and the first frame data $FD_1$ may correspond to a first image. The data line driver 300 may generate the pixel signal P_SIG in response to the first frame data $FD_1$ and output the generated pixel signal P_SIG through the data lines DLs. A period during which the frame data FD corresponding to one image is provided (e.g., the period from time t21 to time t22 in FIG. 2) may be referred to as a frame data period.

At the time t22, the timing controller 200 may transmit vertical blank data VBD through the first channel CH1. The vertical blank data VBD is data transmitted to the data line driver 300 from the timing controller 200 between frame data periods, and in some embodiments, the vertical blank data VBD may include dummy data. A period during which the vertical blank data VBD is transmitted (e.g., the period between time t22 and time t23 in FIG. 2) may be referred to as a vertical blank period. The frame data period and a subsequent vertical blank period may be periodically repeated. At time t22, the data line driver 300 may detect a vertical blank period and may check a training trigger event history (i.e., an occurrence indication for a training trigger event) using (e.g.) data stored in the register REG. Since in the illustrated example of FIG. 2, no training trigger event has occurred by time t22, the data line driver 300 is normally driven.

At time t23, the timing controller 200 transmits second frame data $FD_2$ through the first channel CH1. However, at time t24, a training trigger event occurs during the frame data period associated with the transmission of the second frame data $FD_2$. Upon occurrence of the training trigger event, the register REG stores information TRIG regarding the training trigger event. After the training trigger event occurs, the data line driver 300 waits until the next vertical blank period is detected before transmitting the resulting second training request REQ through the second channel CH2. Accordingly, the timing controller 200 may continue transmitting the second frame data $FD_2$ without interruption, and the data line driver 300 may continue processing of the second frame data $FD_2$. However, some portion of a second image corresponding to the second frame data $FD_2$ transmitted between time t24 and time t25 may include errors. Nonetheless, the image associated with the second frame data $FD_2$ may be output. Further, since the established (or normal) cycle of interleaved frame data periods and vertical blank periods is maintained, a defined frame rate may be maintained, and a next (or third) image corresponding to third frame data $FD_3$ may be normally output in a subsequent frame data period. In contrast, if the data line driver 300 were to transmit a training request REQ through the second channel CH2 at the time t24 upon detecting the training trigger event, the second frame data $FD_2$ could not be transmitted between time t24 and time t25. Accordingly, while the second image corresponding to the second frame data $FD_2$ may include errors over a relatively long (unabbreviated) time period, the transmission period for second image nonetheless remains normally defined and additional errors are not introduced.

At a time t25, the data line driver 300 detects the end of the frame data period or the vertical blank period and may transmit the training request REQ through the second channel CH2 in response to training trigger event information TRIG stored in the register REG. The timing controller 200 may transmit the training pattern TP through the first channel CH1 in response to the training request REQ, and the data line driver 300 may again generate the signal synchronized in response to the training pattern TP. As illustrated in FIG. 2, the register REG may be reset at time t25. However, in other embodiments, the register REG may be reset at time t26 or later following the (re-)training of the first channel CH1.

At time t26, upon successful generation of the signal synchronized in response to the training pattern TP, the data line driver 300 releases the training request REQ through the second channel CH2. The timing controller 200 may then terminate the transmission of the training pattern TP in response to the release of the training request REQ, and since a period corresponding to a normal vertical blank period has not fully passed, vertical blank data VBD may be transmitted between time t26 and time t27. Accordingly, the second training period from time t25 to time t26 is included in the vertical blank period extending from time t25 to time t27, and as a result, the cycle of the frame data periods and the vertical blank periods may be maintained.

At time t27, the vertical blank period is ended, and the timing controller 200 may transmit the third frame data $FD_3$ through the first channel CH1. The data line driver 300 may generate the pixel signal P_SIG from the third frame data $FD_3$ and may output the generated pixel signal P_SIG through the data lines DLs.

Figure 3:
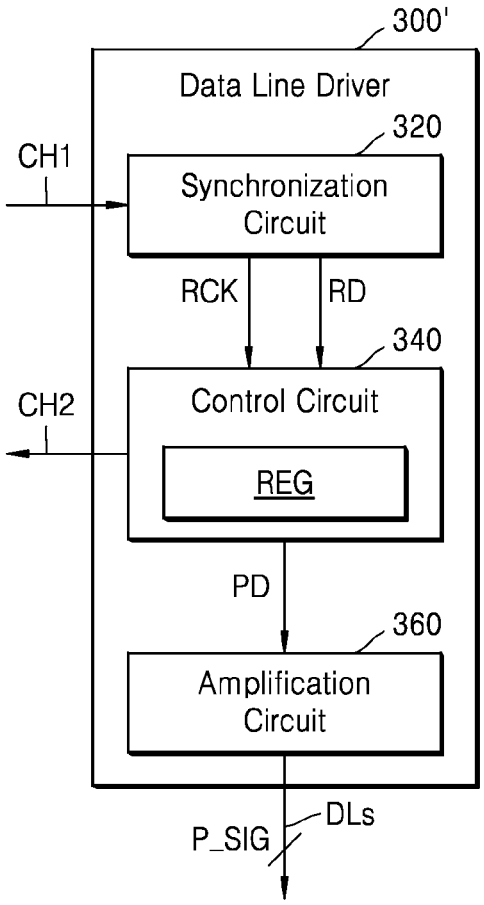
FIG. 3 is a block diagram further illustrating in one example the data line driver of FIG. 1.

FIG. 3 is a block diagram further illustrating in one example (300') the data line driver 300 of FIG. 1. The data line driver 300' of FIG. 3 may communicate with the timing controller 200 through the first channel CH1 and the second channel CH2 and may output the pixel signal P_SIG through the data lines DLs. As illustrated in FIG. 3, the data line driver 300' may include a synchronization circuit 320, a control circuit 340, and an amplification circuit 360.

Referring to FIGS. 1 and 3, the synchronization circuit 320 may generate a recovery clock signal RCK as a signal synchronized with a signal received through the first channel CH1 and may generate recovery data RD from the signal received through the first channel CH1. For example, the synchronization circuit 320 may include a clock data recovery (CDR) circuit and may recover data and a clock in response to a signal including an embedded clock and received through the first channel CH1, thereby outputting the recovery clock signal RCK and the recovery data RD.

The synchronization circuit 320 may generate the recovery clock signal RCK synchronized with a training pattern received through the first channel CH1 in the training period and may generate the recovery data RD in response to the recovery clock signal RCK. As described above with reference to FIG. 2, the training pattern may be received during the initialization of the first channel CH1 or during a subsequently occurring vertical blank period. The synchronization circuit 320 may extract the embedded clock during the training period as well as during the reception of the first frame data FD or the vertical blank data VBD, and may thus maintain synchronization of the recovery clock signal RCK.

The control circuit 340 may be used to output pixel data PD in response to the recovery clock signal RCK and the recovery data RD received from the synchronization circuit 320. The pixel data PD may correspond to at least one pixel included in the display panel 100. Also, the control circuit 340 may include the register REG storing training trigger event information associated with the training trigger event. The control circuit 340 may generate the training trigger event in response to least one of potentially many factors, and may store the resulting training trigger event information in the register REG. Some examples of the control circuit 340 generating a training trigger event will be described hereafter with reference to FIGS. 4A, 4B, 5A, 5B, 6A, 6B and 6C.

The control circuit 340 of FIG. 3 may transmit a training request that requests the training of the first channel CH1 through the second channel CH2 during a vertical blank period in response to training trigger event information stored in the register REG. The control circuit 340 may be used to detect the vertical blank period, and when data associated with the training trigger event the information TRIG (e.g., one or more register values) indicates the generation of the training trigger event, the control circuit 340 may transmit the training request through the second channel CH2 during the vertical blank period. Examples in which the control circuit 340 detects the vertical blank period will be described hereafter with reference to FIGS. 7, 8A and 8B.

The amplification circuit 360 of FIG. 3 may be used to receive the pixel data PD from the control circuit 340, and output the pixel signal P_SIG through the data lines DLs in response to the received pixel data PD. For example, the amplification circuit 360 may include a decoder (e.g., a digital-to-analog converter (DAC)) and an amplifier, and the decoder may provide the amplifier with a gray voltage (or a gray current) corresponding to the pixel data PD. The amplifier may generate the pixel signal P_SIG by amplifying the gray voltage (or the gray current).

Figure 4A:
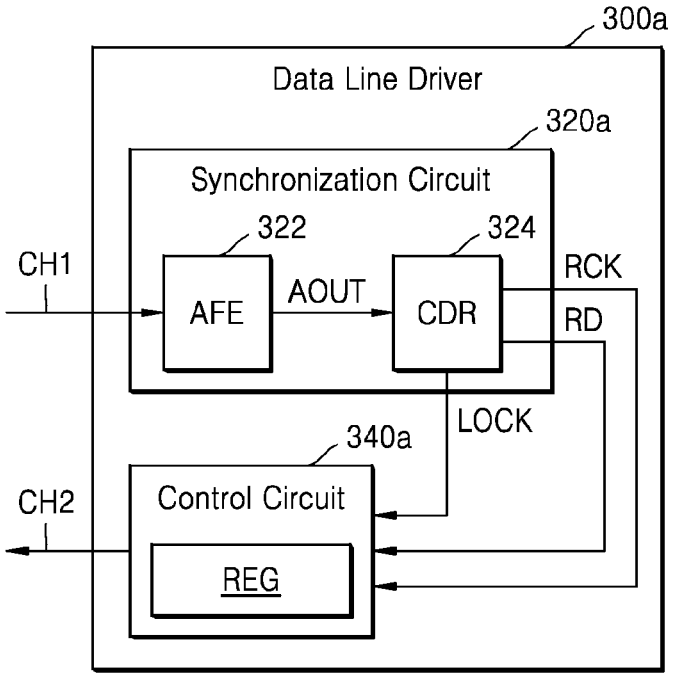
FIG. 4A is a block diagram further illustrating in another example the data line driver of FIG. 1.
Figure 4B:
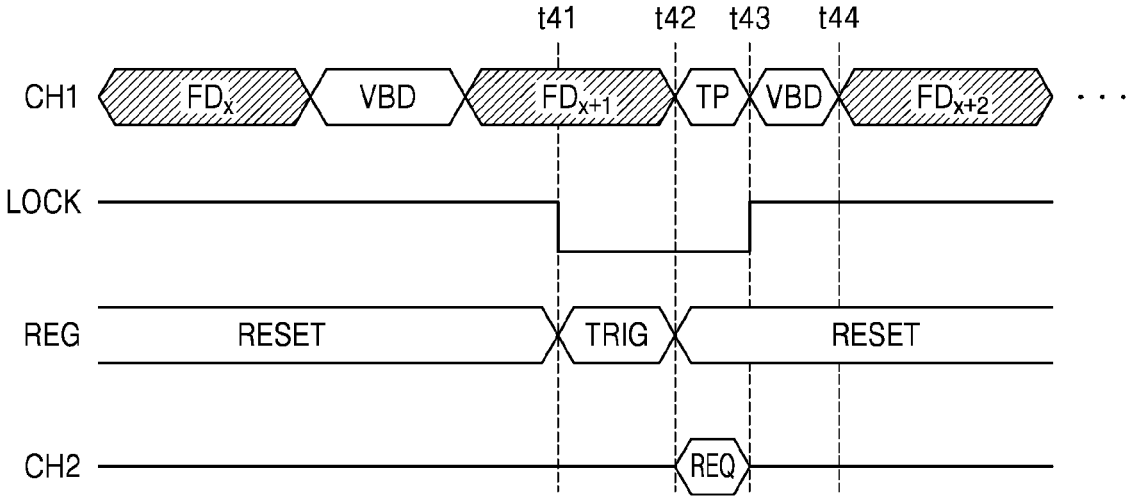
FIG. 4B is a timing diagram further describing in one example the operation of the data line driver of FIG. 4A.

FIG. 4A is a block diagram further illustrating in one example 300*a* the data line driver 300 of FIG. 1. FIG. 4B is a timing diagram further illustrating operation of the data line driver 300*a* of FIG. 4A. Referring to FIGS. 4A and 4B, a training trigger event may be generated using a lock signal LOCK indicating the synchronization of the recovery clock signal RCK. Similar to the descriptions above with reference to FIG. 3, the data line driver 300*a* of FIG. 4A may include a synchronization circuit 320*a* and a control circuit 340*a*.

The synchronization circuit 320*a* may include an Analog Front End (AFE) circuit 322 and a Clock Data Recovery (CDR) circuit 324. The AFE circuit 322 may generate an output signal AOUT from the signal received through the first channel CH1. For example, the AFE circuit 322 may include a termination circuit (e.g., a pull-up resistor and/or a pull-down resistor) for impedance matching of the first channel CH1 and may include a buffer outputting the output signal AOUT having good electrical properties, in response to the signal received through the first channel CH1.

The CDR circuit 324 may generate the recovery clock signal RCK and the recovery data RD from the output signal AOUT received from the AFE circuit 322. Also, the CDR circuit 324 may generate the lock signal LOCK indicating whether the recovery clock signal RCK and/or the recovery data RD are synchronized with the output signal AOUT. For example, when the recovery clock signal RCK and the recovery data RD are synchronized with the output signal AOUT, the CDR circuit 324 may generate an activated lock signal LOCK. When at least one of the recovery clock signal RCK and the recovery data RD is not synchronized with the output signal AOUT, the CDR circuit 324 may generate an inactivated lock signal LOCK. In a period in which the recovery clock signal RCK or the recovery data RD is not synchronized with the output signal AOUT, that is, a period in which the lock signal LOCK is inactivated, the pixel signal P_SIG output by the data line driver 300*a* may not be synchronized with the scan signal S_SIG, or the recovery data RD may not correspond to the data received through the first channel CH1. As a result, the display panel 100 may output an erroneous image.

The control circuit 340*a* may include the register REG and may receive, from the synchronization circuit 320*a*, the recovery clock signal RCK, the recovery data RD, and the lock signal LOCK. The control circuit 340*a* may generate the training trigger event in response to the lock signal LOCK provided from the synchronization circuit 320*a*.

Referring to FIG. 4B, when the lock signal LOCK is inactivated (e.g., transitions from logical high to low) at time t41, the control circuit 340*a* may be used to generate the training trigger event and store corresponding training trigger information TRIG in the register REG. At time t42, the control circuit 340*a* detects the end of the frame data period and the vertical blank period and transmits the training request REQ through the second channel CH2 in response to the training trigger event information TRIG stored in the register REG. The timing controller 200 transmits the training pattern TP through the first channel CH1 in response to the training request REQ, and the CDR circuit 324 of the synchronization circuit 320*a* may attempt generation of the recovery clock signal RCK and the recovery data RD that are synchronized with the training pattern TP.

At time t43, when the CDR circuit 324 finishes generating the recovery clock signal RCK and the recovery data RD that are synchronized with the training pattern TP, the CDR circuit 324 may output an activated (e.g., transition from logical low to high) lock signal LOCK. The control circuit 340*a* may release the training request REQ through the second channel CH2 in response to the activated lock signal LOCK. The timing controller 200 may finish transmitting the training pattern TP in response to the release of the training request REQ and may transmit, through the first channel CH1, the vertical blank data VBD until time t44 when the vertical blank period is ended.

Figure 5A:
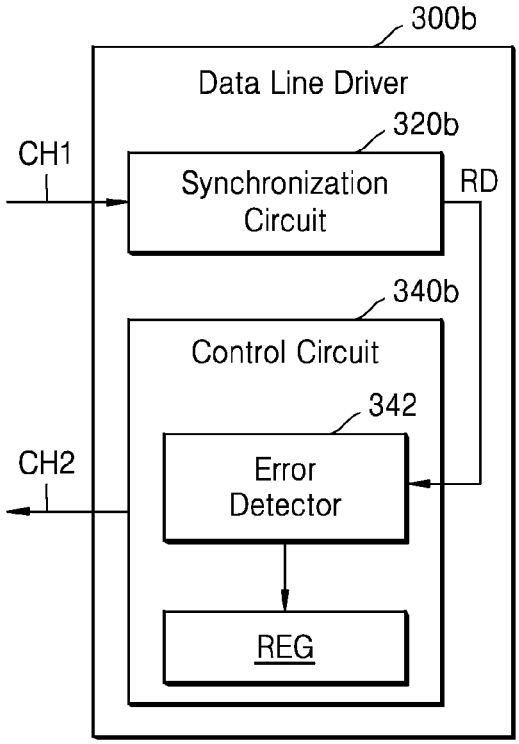
FIG. 5A is a block diagram further illustrating in another example the data line driver of FIG. 1.
Figure 5B:
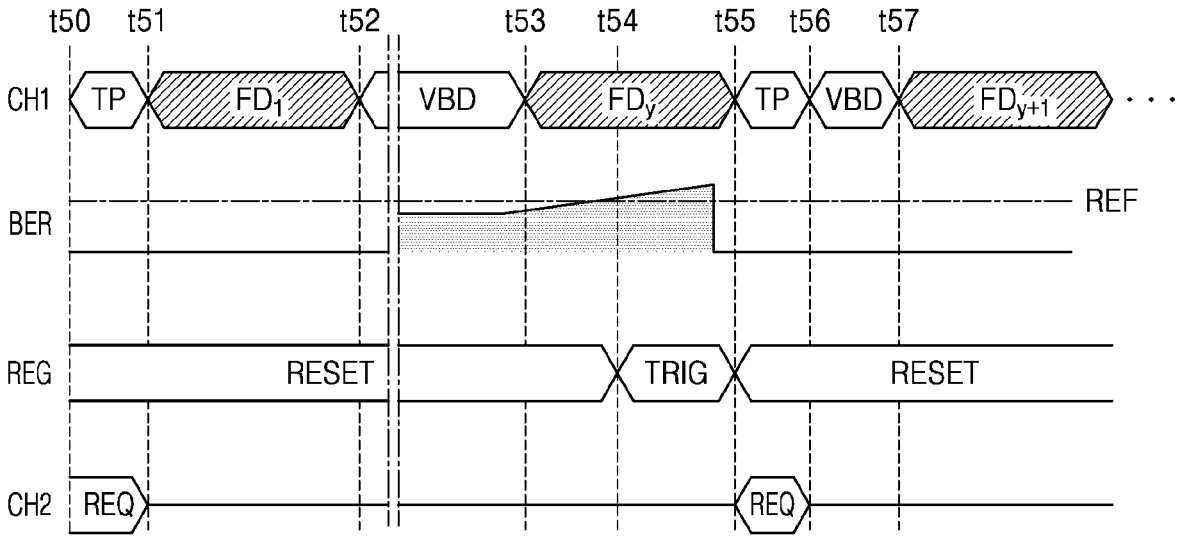
FIG. 5B is a timing diagram further describing in one example the operation of the data line driver of FIG. 5A.

FIG. 5A is a block diagram further illustrating in one example 300*b* the data line driver 300 of FIG. 1. FIG. 5B is a timing diagram further illustrating the operation of the data line driver 300*b* of FIG. 5A. Collectively, FIGS. 5A and 5B illustrate how errors in data received through the first channel CH1 may be detected and a corresponding training trigger event generated in response to the detected errors. Similar to the descriptions provided with reference to FIG. 3, the data line driver 300*b* of FIG. 5A may include a synchronization circuit 320*b* and a control circuit 340*b*.

The synchronization circuit 320*b* may be used to generate the recovery data RD from the signal received through the first channel CH1 and may provide the recovery data RD to the control circuit 340*b*.

The control circuit 340*b* may include an error detector 342 and the register REG. The error detector 342 may detect errors in the data received through the first channel CH1, in response to the recovery data RD provided from the synchronization circuit 320*b*. For example, the timing controller 200 may transmit, through the first channel CH1, data including redundancy bits such as parity bits, and the error detector 342 may detect, from the recovery data RD, the errors in a unit of the data including the redundancy bits. In some embodiments, the error detector 342 may detect the errors in the unit of data by using a Cyclic Redundancy Check (CRC). The error detector 342 may generate the training trigger event according to the errors detected in the unit of the data and may store corresponding training trigger information in the register REG.

In some embodiments, the error detector 342 may generate the training trigger event in response to a bit error rate BER of the data received through the first channel CH1. The bit error rate BER may denote a ratio of erroneous bits to the received data, and the error detector 342 may calculate the bit error rate BER with regard to the errors detected in response to the recovery data RD. The error detector 342 may compare the bit error rate BER with a preset reference value and may generate the training trigger event in response to a comparison result.

Referring to FIG. 5B, after power-up of the display device 10, an initial training period may begin at time t50 and end at time t51. During the initial training period, the bit error rate BER may be reset (e.g.) to zero. From time t51 to time t52, the first frame data $FD_1$ is received from the timing controller 200 through the first channel CH1 during a corresponding frame data period. The error detector 342 may detect errors from the first frame data $FD_1$ and calculate a first bit error rate BER according to the detected errors. In the example of FIG. 5B, the first frame data $FD_1$ received right after the training period from the time t50 to the time t51 may not include errors, and accordingly, the bit error rate BER may be maintained as zero.

At time t53, the vertical blank period is ended, and a $y^{th}$ frame data period may start to receive a corresponding $y^{th}$ frame data $FD_y$. As illustrated in FIG. 5B, a $y^{th}$ bit error rate BER may be greater than zero at time t53 according to the errors detected by the error detector 342 between time t52 and time t53.

The error detector 342 may detect the errors included in the $y^{th}$ frame data $FD_y$ and calculate the $y^{th}$ bit error rate BER according to the detected errors. At time t54, as illustrated in FIG. 5B and assuming that the $y^{th}$ bit error rate BER exceeds a preset threshold value REF, the error detector 342 may generate the training trigger event and store corresponding training trigger event information TRIG in the register REG.

At time t55, the control circuit 340*b* detects the end of the frame data or the vertical blank period and transmits the pending training request REQ through the second channel CH2 in response to the stored training trigger information TRIG stored in the register REG. The timing controller 200 may transmit the training pattern TP through the first channel CH1 in response to the training request REQ, and the synchronization circuit 320*b* may attempt the generation of the recovery data RD synchronized with the training request REQ. Further, the error detector 342 may reset the bit error rate BER to (e.g.) zero. However, in some embodiments, the error detector 342 may reset the bit error rate BER at time t54 when the training trigger event is generated, and in still other embodiments, the error detector 342 may reset the bit error rate BER at time t56 when the channel re-training is complete.

At time t56, when the synchronization circuit 320*b* finishes generating the recovery data RD synchronized with the training pattern TP, the control circuit 340*b* may release the training request REQ through the second channel CH2. Then, the vertical blank data VBD may be received through the first channel CH1 until time t57 when the vertical blank period is ended, and $(y+1)^{th}$ frame data $FD_{y+1}$ may be received from time t57.

Figure 6A:
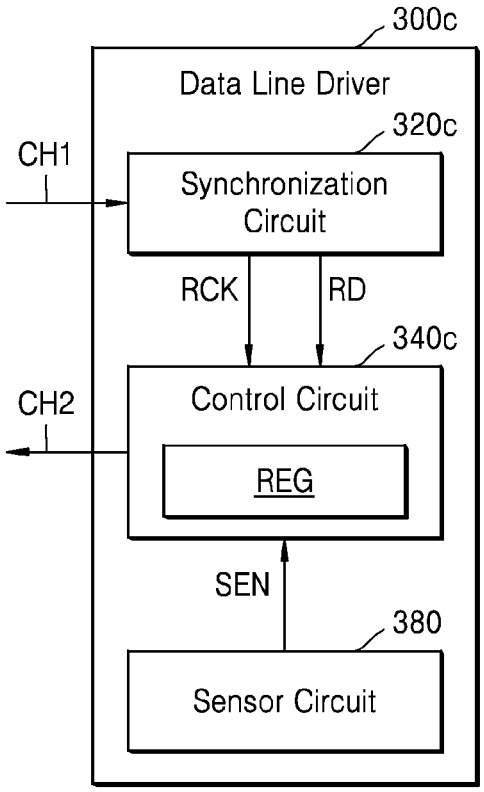
FIG. 6A is a block diagram further illustrating in still another example of the data line driver of FIG. 1.
Figure 6B:
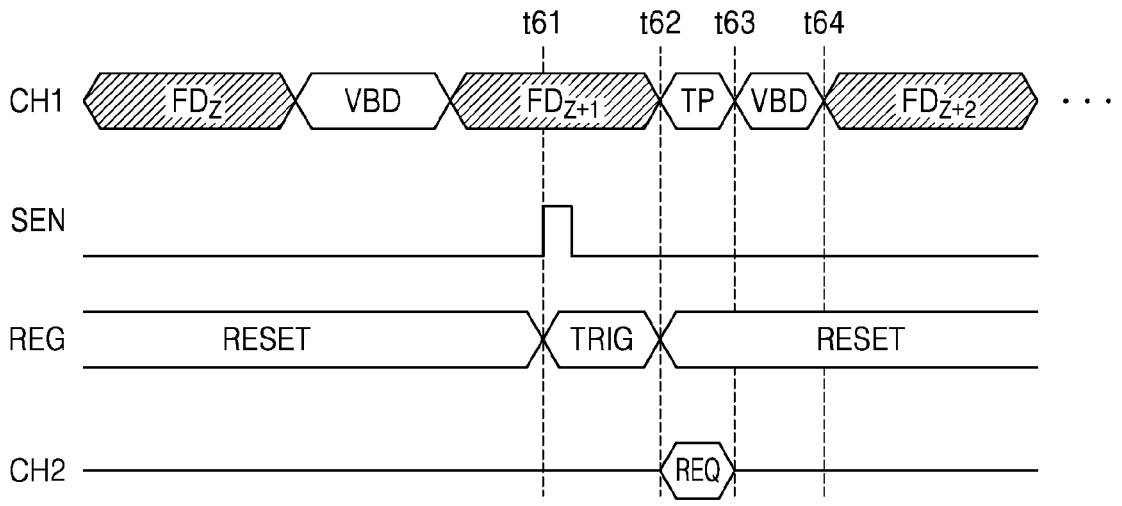
FIGS. 6B and 6C are respective timing diagrams further describing operation of the data line driver of FIG. 6A.
Figure 6C:
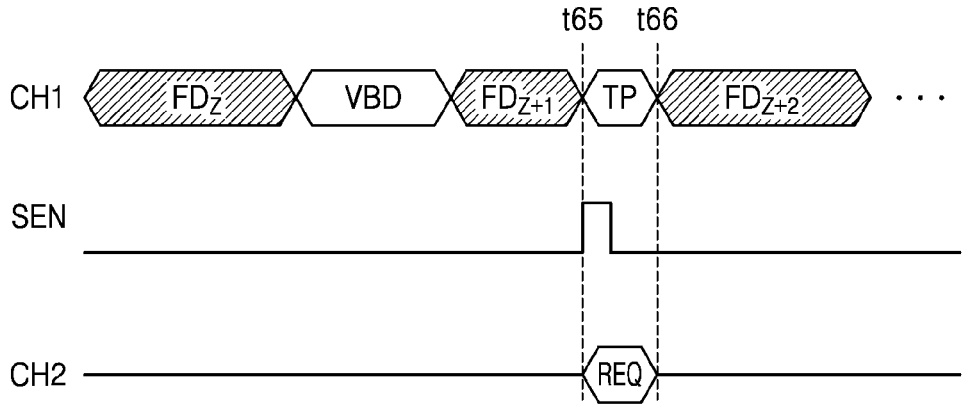

FIG. 6A is a block diagram further illustrating another example 300*c* of the data line driver 300 of FIG. 1. FIGS. 6B and 6C are respective timing diagrams further illustrating the operation of the data line driver 300*c* of FIG. 6A. FIGS. 6A, 6B and 6C collectively illustrate examples of generating a training trigger event by detecting a state of the data line driver 300*c*. Similar to the descriptions provided with reference to FIG. 3, the data line driver 300*c* of FIG. 6A may include a synchronization circuit 320*c* and a control circuit 340*c* and may further include a sensor circuit 380.

Referring to FIG. 6A, the synchronization circuit 320*c* may generate the recovery clock signal RCK and the recovery data RD from a signal received through the first channel CH1 and may provide the generated recovery clock signal RCK and recovery data RD to the control circuit 340*c*. The control circuit 340*c* may include the register REG and may generate the training trigger event in response to a sensing signal SEN provided from the sensor circuit 380.

The sensor circuit 380 may detect a driving state of the data line driver 300*c* (i.e., a data line driving state), so as to generate the sensing signal SEN. In some embodiments, the sensor circuit 380 may include an Electrostatic Discharge (ESD) sensor, and the sensor circuit 380 may output an activated sensing signal SEN when ESD applied to the data line driver 300*c* is detected. In some embodiments, the sensor circuit 380 may include a voltage sensor (e.g., an analog-to-digital converter (ADC) or a comparator), and the sensor circuit 380 may output the activated sensing signal SEN when a voltage supplied to the data line driver 300*c* is less than a preset reference voltage, in order to activate the sensing signal SEN. In some embodiments, the sensor circuit 380 may include a temperature sensor and may output the activated sensing signal SEN when a temperature of the data line driver 300*c* is greater than a preset reference temperature. In some embodiments, as illustrated in FIGS. 6B and 6C, the sensor circuit 380 may generate the sensing signal SEN having an activation pulse of defined width, and in some embodiments, the sensor circuit 380 may generate an inactivated sensing signal SEN in response to a start or an end of the training period.

In the embodiment of FIG. 6A the sensor circuit 380 is included in the data line driver 300*c*. However, in some embodiments, the sensor circuit 380 may be located outside the data line driver 300*c*, and the control circuit 340*c* may receive the sensing signal SEN from the outside of the data line driver 300*c*. For example, the sensor circuit 380 may be included in one of the components of the display device 10 of FIG. 1 which is a detection target of the driving state, or may be included in the display device 10 without being included in the components thereof.

In response to at least one type of many different training trigger event types, the control circuit 340*c* may transmit a training request during a vertical blank period or when a training trigger event is generated. In some embodiments, as to be described below with reference to FIG. 6B, the control circuit 340*c* may store training trigger event information in the register REG and transmit the training request when the frame data period ends. For example, the control circuit 340*c* may store the training trigger event information in the register REG in response to a sensing signal SEN generated by detecting a temperature and/or a voltage when the frame data period ends. Under these conditions, the control circuit 340*c* may transmit the training request.

In some embodiments, as to be described below with reference to FIG. 6B, the control circuit 340*c* may transmit the training request when the training trigger event is generated. For example, the control circuit 340*c* may immediately transmit the training request in response to a sensing signal SEN generated by detecting ESD. Accordingly, as in a case where errors occur during the driving of the data line driver 300*c* due to ESD, when a training trigger event, in which display noise remains until the frame data period ends, is generated, the control circuit 340*c* may immediately transmit the training request without waiting until the vertical blank period. In certain embodiments, a class of training trigger events causing the display noise that remains until the frame data period ends may be referred to as a critical training trigger event.

Referring to FIG. 6B, when the sensing signal SEN is activated at time t61, the control circuit 340*c* may generate the training trigger event and corresponding training trigger event information TRIG in the register REG. At time t62, the control circuit 340*c* may detect the end of the frame data period or the vertical blank period and transmit the training request REQ through the second channel CH2 in response to the training trigger event information TRIG stored in the register REG. The timing controller 200 may transmit the training pattern TP through the first channel CH1 in response to the training request REQ, and the synchronization circuit 320*c* may attempt generation of the recovery clock signal RCK and the recovery data RD synchronized with the training pattern TP.

At time t63, when the synchronization circuit 320*c* completes the generation of the recovery clock signal RCK and the recovery data RD synchronized with the training pattern TP, the control circuit 340*c* may release the training request REQ through the second channel CH2. The timing controller 200 may finish transmitting the training pattern TP in response to the release of the training request REQ and may transmit the vertical blank data VBD through the first channel CH1 until time t64 when the vertical blank period is ended.

Referring to FIG. 6C, when the sensing signal SEN is activated at time t65, the control circuit 340*c* may generate the training trigger event and may transmit the training request REQ through the second channel CH2. The timing controller 200 may transmit the training pattern TP through the first channel CH1 in response to the training request REQ, and the synchronization circuit 320*c* may attempt the generation of the recovery clock signal RCK and the recovery data RD synchronized with the training pattern TP.

At time t66, when the synchronization circuit 320*c* finishes generating the recovery clock signal RCK and the recovery data RD, which are synchronized with the training pattern TP, the control circuit 340*c* may release the training request REQ through the second channel CH2. The timing controller 200 may transmit frame data $FD_{z+2}$ in response to the release of the training request REQ. Accordingly, as the frame data $FD_{z+2}$ is received early, the display noise may be minimized.

Figure 7:
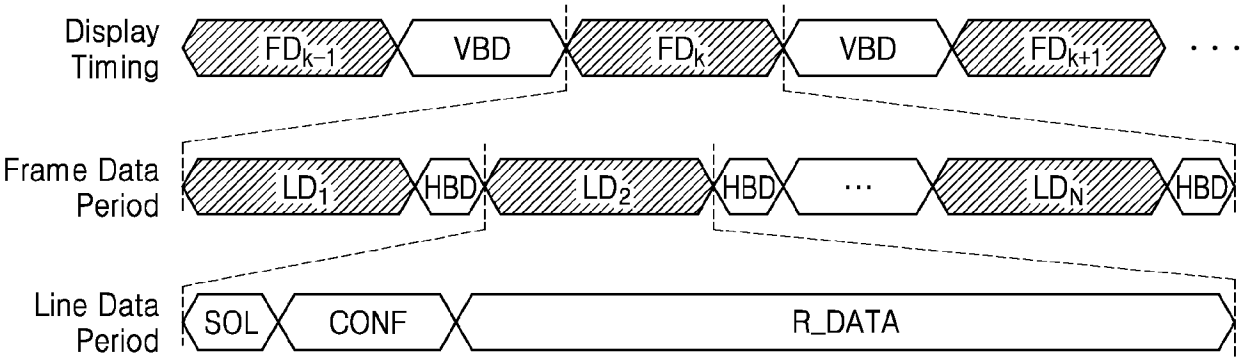
FIG. 7 is a timing diagram further describing in one example the receipt of data through the first channel of FIG. 1.

FIG. 7 is a timing diagram further illustrating in one example the receipt of data through the first channel CH1 of FIG. 1. Hereinafter, it is assumed that the display device 10 of FIG. 1 includes the data line driver 300' of FIG. 3, and FIG. 7 will be described in relation to FIGS. 1 and 3.

Similar to the descriptions provided with reference to FIG. 2, the frame data periods and the vertical blank periods may be periodically repeated. For example, as illustrated in FIG. 7, respective frame data periods, in which pieces of frame data $FD_{k-1}$, $FD_k$, and $FD_{k+1}$ are transmitted, and the vertical blank periods, in which the vertical blank data VBD is transmitted between the frame data periods, may be periodically repeated.

The frame data FD may include line data LD and horizontal blank data HBD. For example, as illustrated in FIG. 7, $k^{th}$ frame data $FD_k$ may include first line data $LD_1$ to $N^{th}$ line data $LD_N$ and the horizontal blank data HBD transmitted between the first line data $LD_1$ to the $N^{th}$ line data $LD_N$. The first line data $LD_1$ to the $N^{th}$ line data $LD_N$ may respectively correspond to pixels included in one row in the display panel 100. For example, the display panel 100 of FIG. 1 may have N rows of pixels, the first line data $LD_1$ may correspond to a first row of the display panel 100, and the $N^{th}$ line data $LD_N$ may correspond to a last row of the display panel 100. Also, the horizontal blank data HBD may include dummy data. A period in which the line data LD is received may be referred to as a line data period, and a period in which the horizontal blank data HBD is received may be referred to as a horizontal blank period.

The line data LD may include fields. For example, as illustrated in FIG. 7, the second line data $LD_2$ corresponding to a second row of the display panel 100 may include fields corresponding to a start of line SOL, configuration data CONF, and row data R_DATA, respectively. The start of line SOL may indicate that the second row starts, and the configuration data CONF may include information about the second frame data $FD_2$. The row data R_DATA may include pieces of data respectively corresponding to pixels included in the second row of the display panel 100.

According to an embodiment, in order to transmit a training request through the second channel CH2 in the vertical blank period, the control circuit 340 of FIG. 3 may detect the end of the frame data period or the vertical blank period in response to information extracted from the line data LD. In some embodiments, the configuration data CONF included in the first line data $LD_1$ may include frame start information, and the control circuit 340 may detect the vertical blank period in response to the frame start information, which is extracted from the first line data $LD_1$, and the number N of rows of the display panel 100. In some embodiments, the configuration data CONF included in the $N^{th}$ line data $LD_N$ may include frame end information, and the control circuit 340 may detect the vertical blank period in response to the frame end information extracted from the $N^{th}$ line data $LD_N$.

Figure 8A:
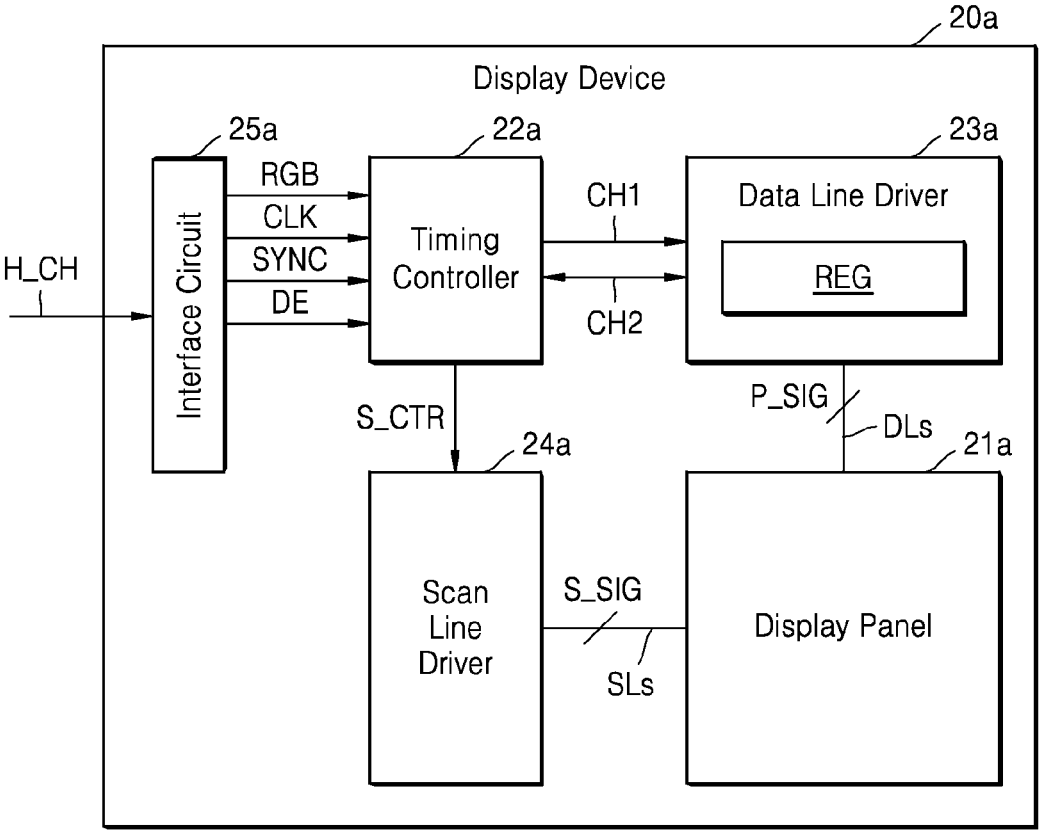
FIGS. 8A and 8B are respective block diagrams illustrating examples of a display device.
Figure 8B:
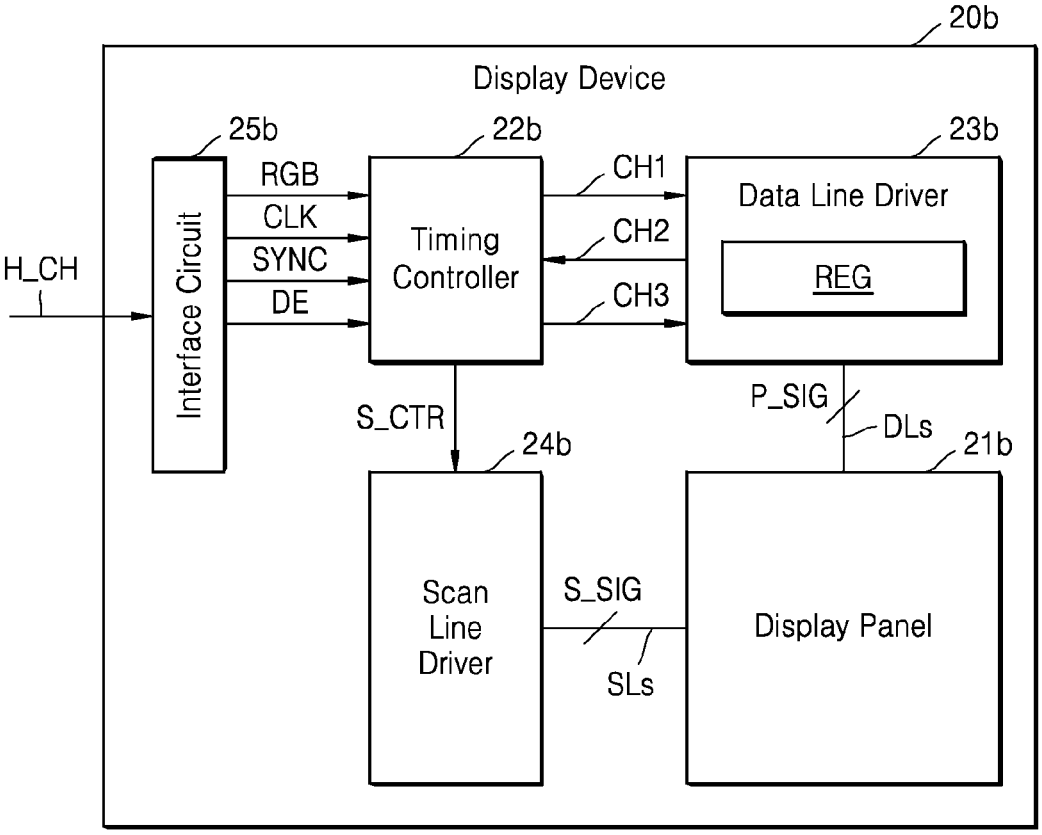

FIGS. 8A and 8B are block diagrams respectively illustrating display devices 20*a* and 20*b* according to embodiments. FIGS. 8A and 8B illustrate examples in which timing controllers 22*a* and 22*b* provide frame signals that allow data line drivers 23*a* and 23*b* to detect the vertical blank periods. Similar to the display device 10 of FIG. 1, the display devices 20*a* and 20*b* of FIGS. 8A and 8B may respectively include display panels 21*a* and 21*b*, the timing controllers 22*a* and 22*b*, the data line drivers 23*a* and 23*b*, scan line drivers 24*a* and 24*b*, and interface circuits 25*a* and 25*b*. The data line drivers 23*a* and 23*b* may each include the register REG storing information about a training trigger event of the first channel CH1.

Referring to FIG. 8A, the timing controller 22*a* and the data line driver 23*a* may communicate through the second channel CH2 (e.g., using a bidirectional channel). Accordingly, the data line driver 23*a* may transmit through the second channel CH2, a training request that requests training of the first channel CH1, and the timing controller 22*a* may transmit a frame signal indicating a vertical blank period (or a frame data period) through the second channel CH2. For example, the timing controller 22*a* may pull up or down signal lines included in the second channel CH2 and thus may transmit the frame signal to the data line driver 23*a*. The data line driver 23*b* may identify the vertical blank period according to the frame signal received through the second channel CH2. In some embodiments, the second channel CH2 may be configured in such a manner that the training request, which is transmitted by the data line driver 23*a* through the second channel CH2, has a higher priority than the frame signal transmitted by the timing controller 22*b* through the second channel CH2.

Referring to FIG. 8B, the timing controller 22*b* and the data line driver 23*b* may communicate with each other through the first and second channels CH1 and CH2 as well as a third channel CH3. The timing controller 22*b* may transmit, to the data line driver 23*b*, a frame signal indicating a vertical blank period (or a frame data period), through the third channel CH3. For example, the third channel CH3 may be one signal line connected to a terminal of the timing controller 22*b* and a terminal of the data line driver 23*b*, and the timing controller 22*b* may transmit the frame signal to the data line driver 23*b* by converting a voltage of the terminal. The data line driver 23*b* may identify the vertical blank period according to the frame signal received through the third channel CH3.

Figure 9:
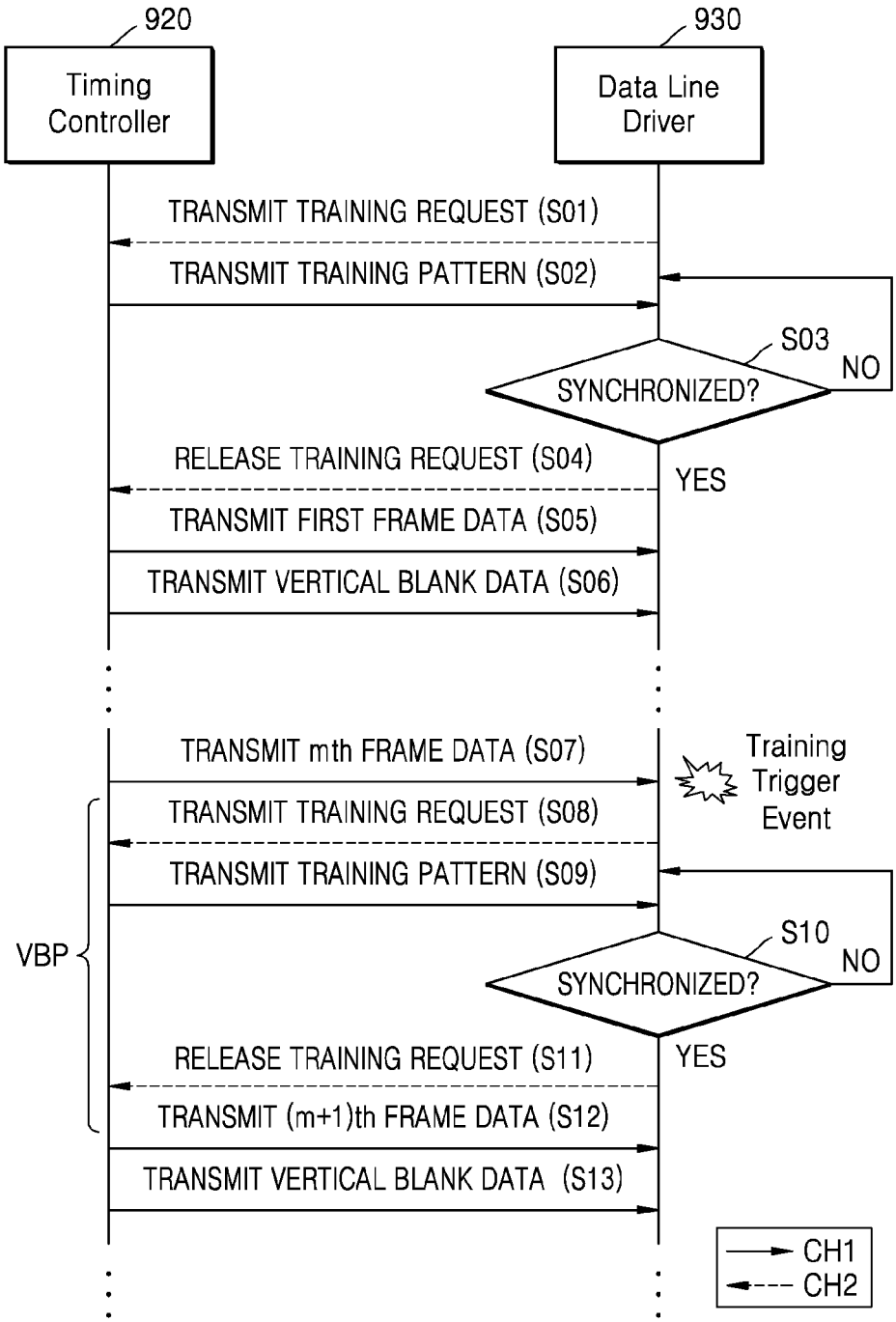
FIG. 9 is a flowchart describing in one example operation between the a timing controller and a data line driver.

FIG. 9 is a flowchart further illustrating interoperation between a timing controller 920 and a data line driver 930 according to certain embodiments.

In operation S01, the data line driver 930 transmits a training request. For example, the data line driver 930 may transmit the training request regarding the first channel CH1 through the second channel CH2. In operation S02, the timing controller 920 transmits a training pattern. For example, the timing controller 920 may transmit the training pattern through the first channel CH1 in response to the training request.

In operation S03, the data line driver 930 determines whether synchronization with the training pattern is successful. The data line driver 930 may receive the training pattern until a signal synchronized with the training pattern is generated. When the signal synchronized with the training pattern being generated is finished, the data line driver 930 may release the training request in operation S04.

In operation S05, the timing controller 920 transmits first frame data, and in operation S06 the timing controller 920 transmits vertical blank data. Subsequently, the timing controller 920 may periodically repeat the transmission of frame data and the vertical blank data. In operation S07, the timing controller 920 transmits $m^{th}$ frame data, and a training trigger event may be generated while the data line driver 930 receives the $m^{th}$ frame data.

In operation S08, when the $m^{th}$ frame data is received (e.g., during a vertical blank period VBP), the data line driver 930 transmits the training request. Accordingly, the training period according to the training trigger event may be included in the vertical blank period VBP. In operation S09, the timing controller 920 transmits the training pattern, and in operation S10, the data line driver 930 determines whether synchronization with the training pattern is successful.

When the signal synchronized with the training pattern is generated, the data line driver 930 releases the training request in operation S11. Then, in operation S12, the timing controller 920 transmits $(m+1)^{th}$ frame data, and in operation S13, the timing controller 920 transmits the vertical blank data.

Figure 10:
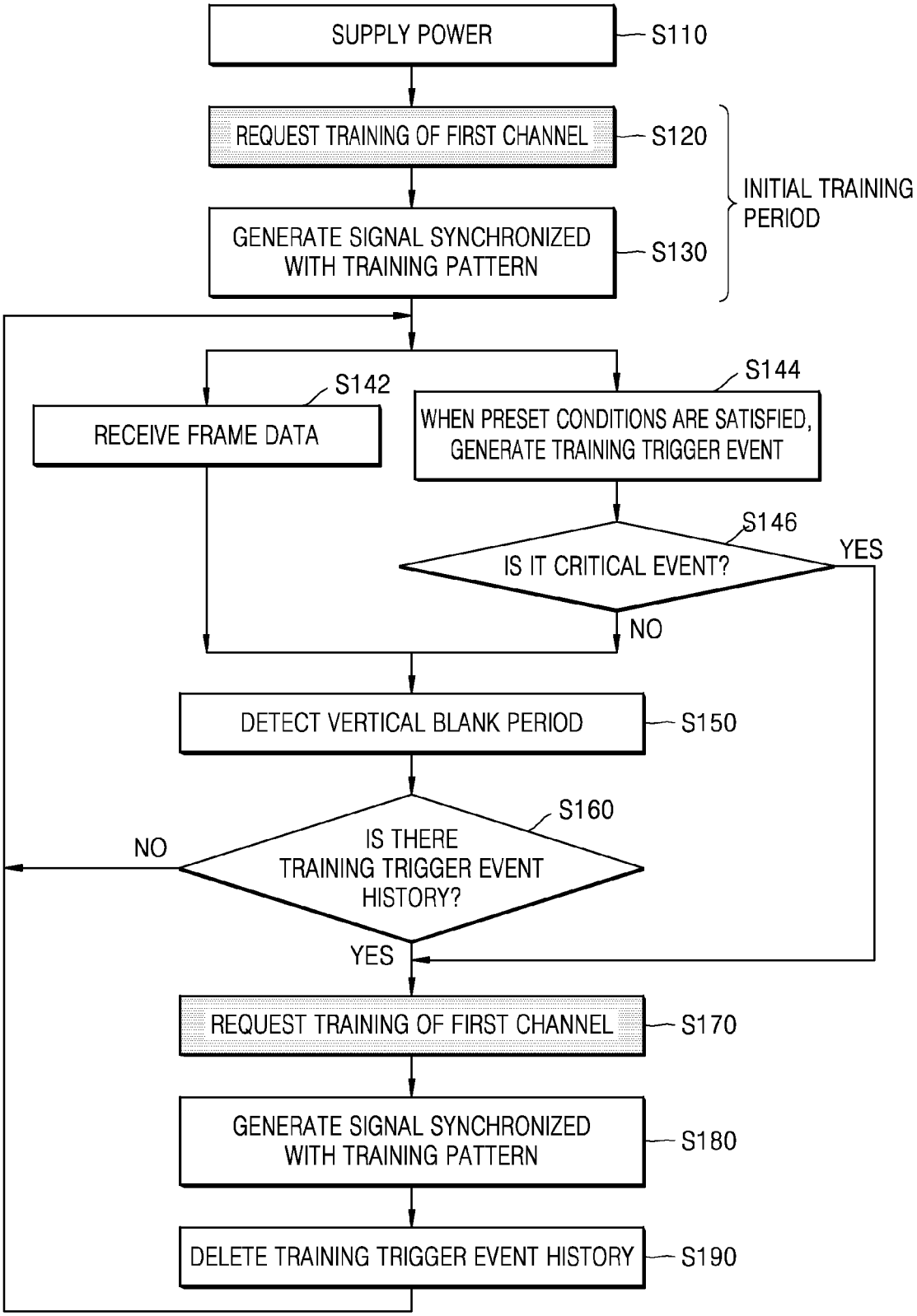
FIG. 10 is a flowchart describing of a method of driving a display.

FIG. 10 is a flowchart summarizing in one example a method of driving a display according to an embodiment. For example, the method of FIG. 10 may be performed by the data line driver 300 included in the display device 10 of FIG. 1 and may be referred to as a method of driving the data line driver 300. As illustrated in FIG. 10, operations S120 and S130 may be performed in an initial training period. Hereinafter, the method of FIG. 10 will be described with reference to FIG. 1.

In operation S110, power is supplied (power-up) to the display device 10. For example, as power is supplied to the display device 10, power may be supplied to the data line driver 300.

In operation S120, training of the first channel CH1 is requested. For example, the data line driver 300 may transmit the training request to the timing controller 200 through the second channel CH2.

In operation S130, a signal synchronized with a training pattern is generated. For example, the data line driver 300 may receive the training pattern from the timing controller 200 through the first channel CH1 and may generate the signal (e.g., the recovery clock signal RCK and the pixel data PD of FIG. 3) synchronized with the training pattern. As illustrated in FIG. 10, operations S142 and S144 may be performed in parallel after operation S130.

In operation S142, frame data is received. For example, the data line driver 300 may receive the frame data including a series of line data and may generate the pixel signal P_SIG by processing the frame data. Also, in operation S144, when a preset condition is satisfied, a training trigger event is generated. For example, the data line driver 300 generates the training trigger event in response to at least one of whether the signal is synchronized with the training pattern, errors in data received through the first channel CH1, and an output signal of a sensor circuit. Then, in operation S146, a determination as to whether the training trigger event is a critical training trigger event is made. For example, the data line driver 300 may determine whether the training trigger event is a critical training trigger event in response to an underlying cause of the training trigger event. When the training trigger event is not critical, corresponding training trigger information may be stored in the register REG, and operation S150 may be subsequently performed. On the other hand, when the training trigger event is critical, training of the first channel CH1 is immediately requested beginning with operation S170.

In operation S150, the vertical blank period is detected. For example, the data line driver 300 may detect the vertical blank period in response to information extracted from the line data and may detect the vertical blank period in response to the frame signal received from the timing controller 200. Examples of operation S150 will be described with reference to FIGS. 11A and 11B.

In operation S160, a determination as to whether a training trigger event history exists is made. For example, the data line driver 300 may determine whether the training trigger event occurs, in response to training trigger information stored in the register REG. When a training trigger event history exists, operation S170 may be performed, and when the training trigger event history does not exist, operations S142 and S144 may be performed in parallel.

Similar to operations S120 and S130, the training of the first channel CH1 may be requested in operation S170, and in operation S180, the signal synchronized with the training pattern is generated.

In operation S190, the training trigger event history is deleted. For example, the data line driver 300 may reset the register REG and thus may delete training trigger event information stored in the register REG. FIG. 10 illustrates that operation S190 is performed after operation S180. However, in some embodiments, operation S190 may be performed between operation S160 and operation S170. In some embodiments, operation S190 may be performed between operation S170 and operation S180, and in some embodiments, operation S190 may be performed in parallel with operation S170 and/or operation S180.

Figure 11A:
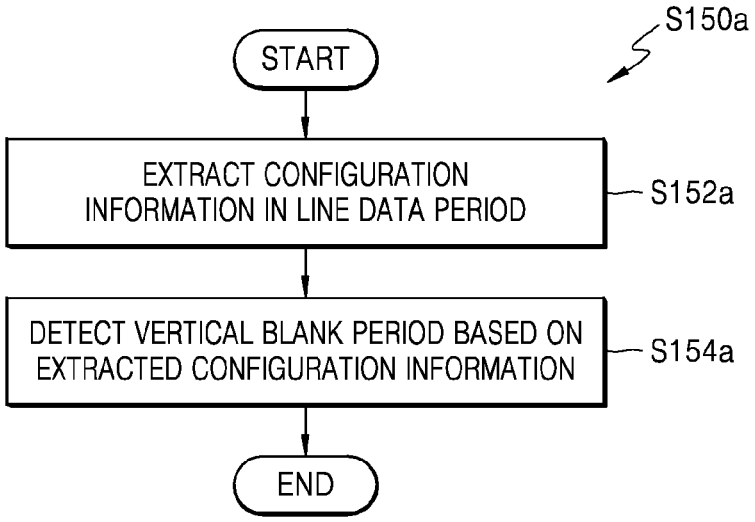
FIGS. 11A and 11B are flowcharts further describing operation S150 of the method illustrated in FIG. 10.
Figure 11B:
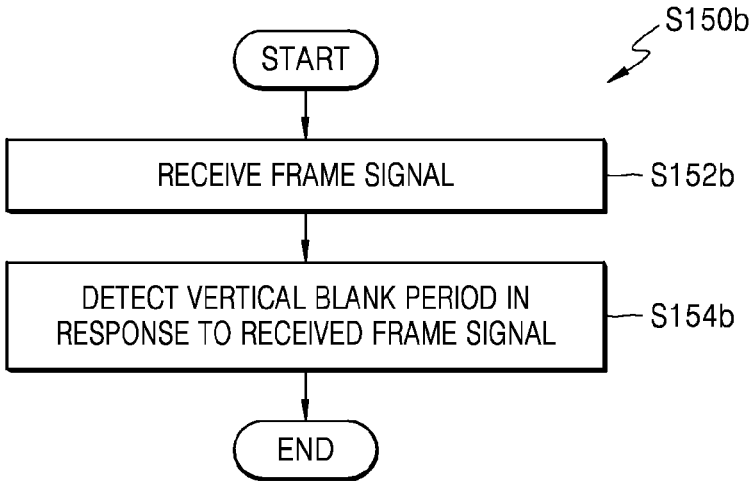

FIGS. 11A and 11B are respective flowcharts further illustrating examples of operation S150 of FIG. 10. As described above with reference to FIG. 10, in operations S150*a* and S150*b* of FIGS. 11A and 11B, a vertical blank period is detected. When there is a training trigger event history, the training of the first channel CH1 may be requested during the detected vertical blank period. Hereinafter, operations S150*a* and S150*b* of FIGS. 11A and 11B will be described with reference to FIG. 1.

Referring to FIG. 11A, in operation S152*a*, configuration information is extracted during a line data period. For example, the data line driver 300 may extract frame start information and/or frame end information from configuration data included in line data received in the line data period.

In operation S154*a*, the vertical blank period is detected in response to the configuration information. In some embodiments, the data line driver 300 may detect the vertical blank period in response to the extracted frame start information and the number of rows included in the display panel 100. In some embodiments, the data line driver 300 may extract the vertical blank period in response to the extracted frame end information.

Referring to FIG. 11B, in operation S152*b*, a frame signal is received. In some embodiments, the data line driver 300 may receive the frame signal provided by the timing controller 200, through the second channel CH2 that is a bidirectional channel. In some embodiments, the data line driver 300 may receive the frame signal provided by the timing controller 200 through the third channel CH3 different from the first channel CH1 and the second channel CH2.

In operation S154*b*, in response to the frame signal, the vertical blank period is detected. In some embodiments, the frame signal may indicate the frame data period, and the data line driver 300 may extract a period excluding the frame data period as the vertical blank period. In some embodiments, the frame signal may indicate the vertical blank period, and the data line driver 300 may detect the vertical blank period in response to the frame signal.

Figure 12:
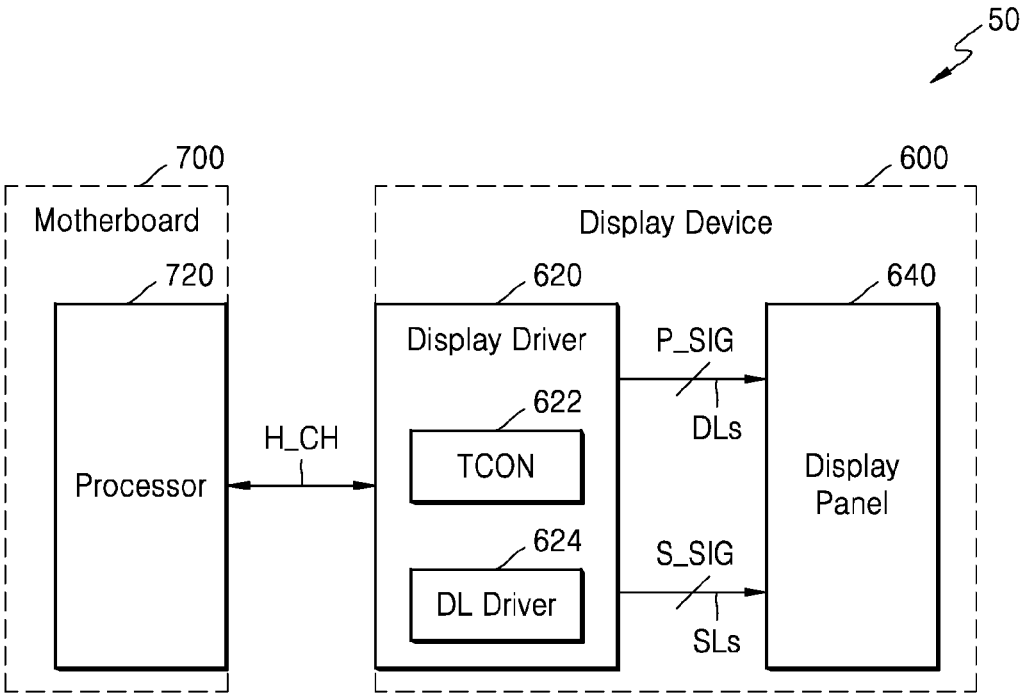
FIG. 12 is a block diagram of a system including a timing controller and a data line driver.

FIG. 12 is a block diagram of a system 50 including a timing controller 622 and a data line driver 624 according to an embodiment. The timing controller 622 and the data line driver 624 according to an embodiment may be included in a display driver 620. The system 50 may be a computing system including a display device 600, and as a non-limited example, the system 50 may be a stationary system such as a desktop computer, a server, a TV, or a billboard, or a mobile system such as a laptop computer, a mobile phone, a tablet PC, or a wearable device. As illustrated in FIG. 12, the system 50 may include a mother board 700 and the display device 600, and through a host channel H_CH, the mother board 700 and the display device 600 may communicate with each other.

The mother board 700 may include a processor 720 and may function as a host of the display device 600. As a non-limited example, the processor 720 may be a processing unit, e.g., a microprocessor, a microcontroller, an Application Specific Integrated Circuit (ASIC), and a Field Programmable Gate Array (FPGA), which performs computational operations. In some embodiments, the processor 720 may be a video graphic processor such as a Graphics Processing Unit (GPU). The processor 720 may generate image data corresponding to an image output through a display panel 640 included in the display device 600, and the image data may be provided to the display device 600 through the host channel H_CH.

The display device 600 may include the display driver 620 and the display panel 640. The display driver 620 may be referred to as a Display Driver IC (DDI) and may include the timing controller 622 and the data line driver 624, which communicate with each other through a first channel and a second channel. For example, the timing controller 622 may provide a training pattern through the first channel CH1 in response to a training request through the second channel of the data line driver 624, and may provide signals and/or information that the data line driver 624 uses to detect the vertical blank period. Also, the data line driver 624 may generate a training trigger event in response to at least one of various factors, and when the training trigger event occurs, the data line driver 624 may transmit the training request through the second channel in the vertical blank period. Accordingly, an amount of erroneous images output through the display panel 640 may decrease, and as continuity of images output through the display panel 640 is maintained, visual effects produced due to errors may decrease.

The display panel 640 may be embodied, for example, as an arbitrary display such as a Liquid Crystal Display (LCD), a Light Emitting Diode (LED) display, an Electroluminescent Display (ELD), a Cathode Ray Tube (CRT), a Plasma Display Panel (PDP), or a Liquid Crystal on Silicon (LCoS). Also, FIG. 12 illustrates that the system 50 includes one display device 600, but in some embodiments, the system 50 may include at least two display devices, that is, at least two display panels.

While the inventive concept has been particularly shown and described with reference to embodiments thereof, it will be understood that various changes in form and details may be made therein without departing from the spirit and scope of the following claims.

What is claimed is:

1. A data line driving circuit configured to communicate with a controller through a first channel and a second channel, the data line driving circuit comprising:

a control circuit comprising a register configured to store training trigger event information when a training trigger event occurs, wherein the control circuit is configured to detect a vertical blank period between frame data periods, and transmit a training request directed to the first channel through the second channel during and based on being in the vertical blank period and not the frame data periods in response to the training trigger event information; and a synchronization circuit configured to generate a recovery clock signal synchronized with a training pattern received through the first channel during the vertical blank period, and generate recovery data from a signal received through the first channel in response to the recovery clock signal during a frame data period.

2. The data line driving circuit of claim 1, wherein the synchronization circuit is further configured to generate a lock signal indicating whether the recovery clock signal is synchronized with the signal received through the first channel, and the control circuit is further configured to generate the training trigger event in response to the lock signal.

3. The data line driving circuit of claim 1, further comprising an error detector configured to detect errors in the recovery data, wherein the control circuit is further configured to generate the training trigger event in response to the detected errors.

4. The data line driving circuit of claim 3, wherein the control circuit is further configured to calculate a bit error rate in response to the detected errors and generate the training trigger event in response to the calculated bit error rate.

5. The data line driving circuit of claim 1, further comprising a sensor circuit configured to detect a data line driving circuit state, wherein the control circuit is further configured to generate the training trigger event in response to an output signal of the sensor circuit.

6. The data line driving circuit of claim 5, wherein the data line driving circuit state comprises at least one of; an electrostatic discharge associated with the data line driving circuit, a voltage associated with the data line driving circuit, and a temperature associated with the data line driving circuit.

7. The data line driving circuit of claim 1, wherein the control circuit is further configured to immediately transmit a training request directed to the first channel for a critical training trigger.

8. The data line driving circuit of claim 1, wherein the frame data period comprises a plurality of line data periods, and the control circuit is further configured to extract frame start information from line data in a first line data period among the plurality of line data periods, and detect the vertical blank period in response to the frame start information.

9. The data line driving circuit of claim 1, wherein the frame data period comprises a plurality of line data periods, and the control circuit is further configured to extract frame end information from line data in a last line data period among the plurality of line data periods, and detect the vertical blank period in response to the frame end information.

10. The data line driving circuit of claim 1, wherein the second channel is a bidirectional channel, and control circuit is further configured to receive a frame signal through the second channel and detect the vertical blank period in response to the frame signal.

11. The data line driving circuit of claim 1, wherein the control circuit is further configured to receive a frame signal from the controller through a third channel different from the first channel and the second channel, and detect the vertical blank period in response to the frame signal.

12. A display driving circuit comprising:

a controller configured to transmit frame data through a first channel during a frame data period and transmit a training pattern through the first channel in response to a training request received through a second channel; and a data line driving circuit configured to detect a vertical blank period between frame data periods in response to a signal received from the controller and transmit the training request through the second channel during and based on being in the vertical blank period and not the frame data periods.

13. The display driving circuit of claim 12, wherein the frame data comprises a series of line data, and the data line driving circuit is further configured to extract configuration information from the series of line data and extract the vertical blank period in response to the configuration information.

14. The display driving circuit of claim 12, wherein the second channel is a bidirectional channel and the controller is further configured to transmit a frame signal through the second channel, and the data line driving circuit is further configured to detect the vertical blank period in response to the frame signal.

15. The display driving circuit of claim 12, wherein the controller is further configured to transmit a frame signal through a third channel different from the first channel and the second channel, and the data line driving circuit is further configured to detect the vertical blank period in response to the frame signal.

16. A method of driving a display by communicating with a controller through a first channel and a second channel, the method comprising:

generating recovery data from a signal received through the first channel during a frame data period;

detecting a vertical blank period between frame data periods;

checking a training trigger event history during the vertical blank period; and during and based on being in the vertical blank period and not the frame data periods, transmitting a training request directed to the first channel through the second channel when there is a training trigger event history.

17. The method of claim 16, further comprising:

during the vertical blank period, generating a recovery clock signal synchronized with a training pattern received through the first channel, wherein the generating of the recovery data comprises generating the recovery data in response to the recovery clock signal.

18. The method of claim 16, wherein the frame data period comprises a plurality of line data periods, and the detecting of the vertical blank period comprises:

extracting configuration information during each of the plurality of line data periods; and detecting the vertical blank period in response to the configuration information.

19. The method of claim 16, wherein the second channel is bidirectional and detecting of the vertical blank period comprises:

receiving a frame signal through the second channel; and detecting the vertical blank period in response to the frame signal.

20. The method of claim 16, wherein the detecting of the vertical blank period comprises:

receiving a frame signal from the controller through a third channel different from the first channel and the second channel; and detecting the vertical blank period in response to the frame signal.

* * * * *